US007428394B2

(12) United States Patent
Yoshida et al.

(10) Patent No.: US 7,428,394 B2
(45) Date of Patent: Sep. 23, 2008

(54) ELECTRONIC COLOR PHOTOGRAPHY APPARATUS

(75) Inventors: Tomofumi Yoshida, Ibaraki (JP); Kazuhiro Wakamatsu, Ibaraki (JP); Masahiko Saito, Ibaraki (JP); Yasuhiro Kiyono, Ibaraki (JP); Shunichi Oohara, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 227 days.

(21) Appl. No.: 11/138,207

(22) Filed: May 27, 2005

(65) Prior Publication Data

US 2005/0265703 A1 Dec. 1, 2005

(30) Foreign Application Priority Data

May 28, 2004 (JP) ..... P2004-158594

(51) Int. Cl.
*G03G 21/16* (2006.01)
*G03G 21/18* (2006.01)

(52) U.S. Cl. ..... 399/111; 399/112

(58) Field of Classification Search ..... 396/30; 355/23, 27, 30; 399/223, 226, 228, 111, 399/112
See application file for complete search history.

(56) References Cited

U.S. PATENT DOCUMENTS

| | | | | |
|---|---|---|---|---|
| 4,891,672 | A * | 1/1990 | Takagi | 399/226 |
| 5,014,095 | A * | 5/1991 | Yamada | 399/226 |
| 2003/0081966 | A1 * | 5/2003 | Wakamatsu et al. | 399/228 |
| 2004/0165910 | A1 * | 8/2004 | Sato et al. | 399/116 |

FOREIGN PATENT DOCUMENTS

| | | |
|---|---|---|
| KR | 1998-025029 | 7/1998 |
| KR | 2000-0026592 | 5/2000 |
| KR | 10-2001-0038780 | 5/2001 |
| KR | 2003-0064147 | 7/2003 |
| KR | 10-2004-0002453 | 1/2004 |

* cited by examiner

*Primary Examiner*—Della J. Rutledge
(74) *Attorney, Agent, or Firm*—McGinn IP Law Group, PLLC

(57) ABSTRACT

An electronic color photography apparatus includes a photosensitive body and a plurality of detachable developing devices. A power for moving the developing devices close to the photosensitive body is created by a retracting force of a slanted teeth gear which is driven at one side of a body of the electronic color photography apparatus.

20 Claims, 2 Drawing Sheets

ELECTRONIC COLOR PHOTOGRAPHY APPARATUS

BACKGROUND OF THE INVENTION

1. Field of the Invention

The present invention relates to an electronic color photography apparatus provided with a mechanism for developing an electronic latent image on a photosensitive body with minute particles such as toner.

2. Description of the Related Art

In an electronic color photography apparatus, particularly, in the electronic color photography apparatus of such a type that developments and primary transfers are conducted in respective colors, then, a full color image is formed on an intermediate transfer body, and thereafter, a secondary transfer is conducted in a lump thereby to form a color image, in case of developing an electronic latent image on a photosensitive body with minute particles such as toner, a developing device for a selected developing color comes close to or into contact with the photosensitive body to electrically and physically apply the minute particles such as toner to the photosensitive body, whereby the electronic latent image will be developed. In the meantime, other developing devices for developing colors which have not been selected are retracted by springs or the like for imposing loads in a direction away from the photosensitive body by such a distance or to such a position that the development cannot be effected with the minute particles such as toner on the photosensitive body.

In the conventional electronic color photography apparatus, as means for bringing the developing device close to or into contact with the photosensitive body for the purpose of developing the electronic latent image on the photosensitive body with the minute particles such as toner, there has been a method of pushing the developing device toward the photosensitive body by a cam or the like which is provided in a driving device of the electronic color photography apparatus behind the developing device.

There has been another method, wherein a body of the electronic color photography apparatus is provided with gears, and the developing device is also provided, at both sides thereof, with driving devices for gears which are meshed with the gears on the body of the electronic color photography apparatus, so as to actuate the gears according to a timing on which the developing device comes close or into contact with the photosensitive body.

SUMMARY OF THE INVENTION

In the conventional electronic color photography apparatus, in case of the method of pushing the developing device toward the photosensitive body by the cam or the like which is provided in the driving device of the body of the electronic color photography apparatus behind the developing device, this has led to an increase, in number, of driving mechanisms for actuating the cams and components such as clutches in the body of the electronic color photography apparatus. As the results, assembling steps have become complicated, and cost for material has increased, which has been detrimental to a low cost of the electronic color photography apparatus. Further, a large space for installing the mechanisms has been required, which has been also a factor of upsizing.

On the other hand, in case of the method wherein the body of the electronic color photography apparatus is provided with the gear, and the developing device is also provided, at both the sides thereof, with the gears which are meshed with the gears on the body of the electronic color photography apparatus, so as to actuate the gears according to a timing on which the developing device comes close to or into contact with the photosensitive body, there have been employed such means as providing driving devices on the body of the electronic color photography apparatus at both sides thereof, or as composing a driving device by way of a shaft from an actuating side to an opposite side. This has also led to an increase, in number, of the components, the complicated assembling steps, and an increase of the cost for material, which has been also detrimental to a low cost of the electronic color photography apparatus.

It is an object of the invention to provide an electronic color photography apparatus includes: a photosensitive body; and a plurality of detachable developing devices. Among approaching and separating actions of the developing devices, a power for moving the developing devices close to the photosensitive body is created by a retracting force of a slanted teeth gear which is driven at one side of a body of the electronic color photography apparatus. A power for approaching and separating the developing device such as pushing it toward the photosensitive body on occasion of developing is created only by the retracting force of the slanted teeth gear which is driven from one side of the electronic color photography apparatus, whereby the electronic color photography apparatus which can realize a necessary minimum number of components, simplified assembling steps, and reduced cost for material, while requiring a least installing space can be obtained.

According to one aspect of the invention, an electronic color photography apparatus includes a photosensitive body and a plurality of detachable developing devices. Among approaching and separating actions of the developing devices, a power for moving the developing devices close to the photosensitive body is created by a retracting force of a slanted teeth gear which is driven at one side of a body of the electronic color photography apparatus. In other words, among the approaching and separating actions of the developing devices, a mechanism for moving the developing devices close to the photosensitive body for the purpose of forming a uniform Nip in a lateral direction of paper is arranged at one side of the body of the electronic color photography apparatus.

According to another aspect of the invention, a power for contacting the developing devices with the one side of body of the apparatus is a mechanism for smoothing the movement of the developing devices to come close to the photosensitive body.

According to another aspect of the invention, the mechanism for smoothing the movements of the developing devices to come close to the photosensitive body includes a roller which is provided on the body of the electronic color photography apparatus.

According to another aspect of the invention, an electronic color photography apparatus including: a plurality of developing devices capable of being filled with toners, each developing device having: a developing roller: and a position determining section in parallel with a moving direction of the developing device; a main body of the electronic color photography apparatus, the main body placing a roller to be contact with the position determining section; a photosensitive belt forming a latent image by coming close to or being contact with the developing roller when the developing devices are moved, so that the electric color photography apparatus performs a color photography by transferring the latent image to a recording medium; a developing device driving mechanism actuating the developing roller; a first slanted teeth gear transferring a driving force of the developing device driving mechanism to the developing roller; a second slanted teeth gear provided with a rotation axis of the developing roller; and a stopper operable to determine a retracted position of the developing devices.

According to another aspect of the invention, the roller is disposed on the main body of the electronic color photography apparatus through a spring.

By thus configuration, it is possible to provide the electronic color photography apparatus which can realize a necessary minimum number of components, simplified assembling steps, and reduced cost for material, while a least installing space is required.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Now, a structure and operation of the electronic color photography apparatus according to an embodiment of the invention will be described, referring to FIGS. 1 and 2.

Figure 1:
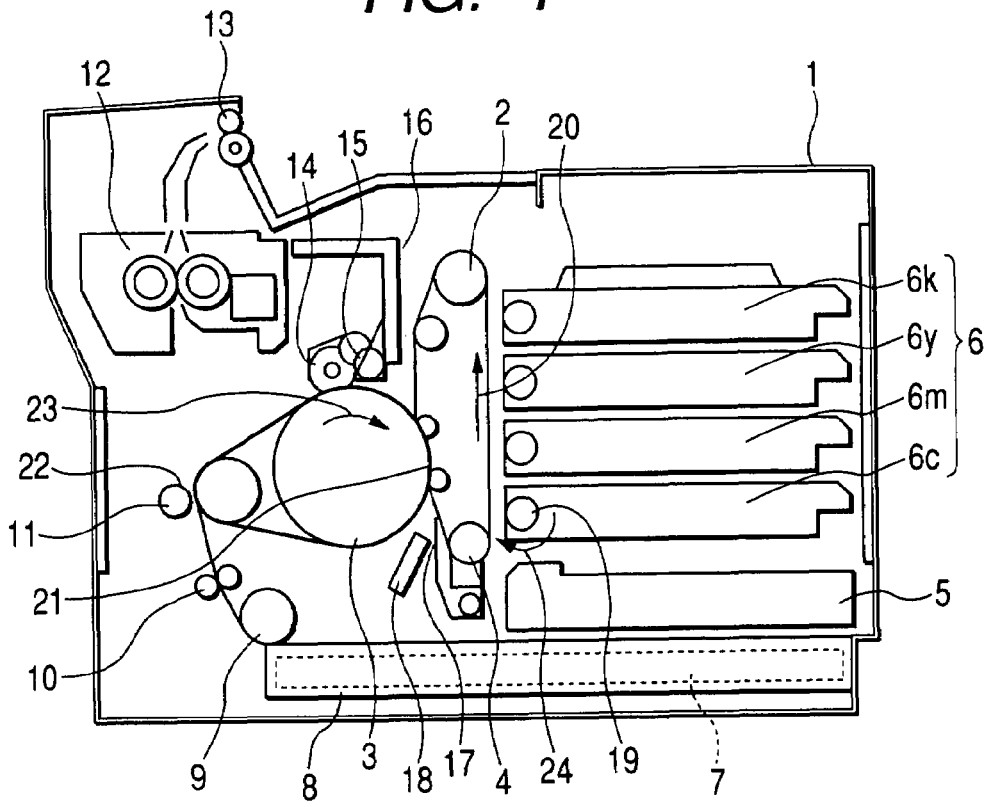
FIG. 1 is a sectional view schematically showing an electronic color photography apparatus in an embodiment of the invention.
Figure 2:
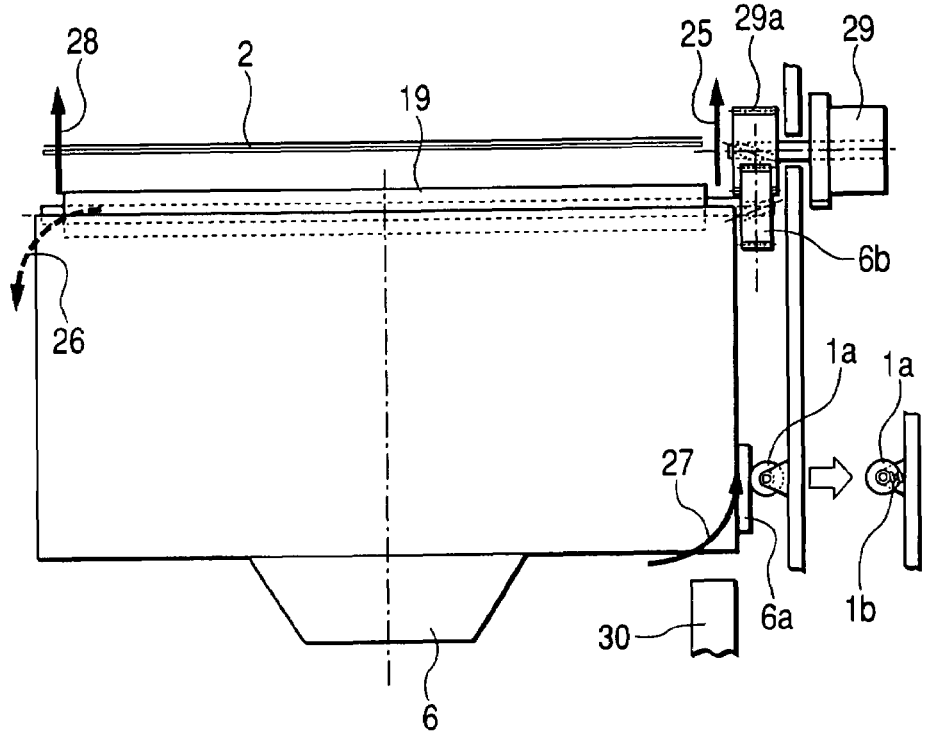
FIG. 2 is a view schematically showing a driving mechanism at one side of a developing device in the electronic color photography apparatus according to the embodiment of the invention.
Figure 3:
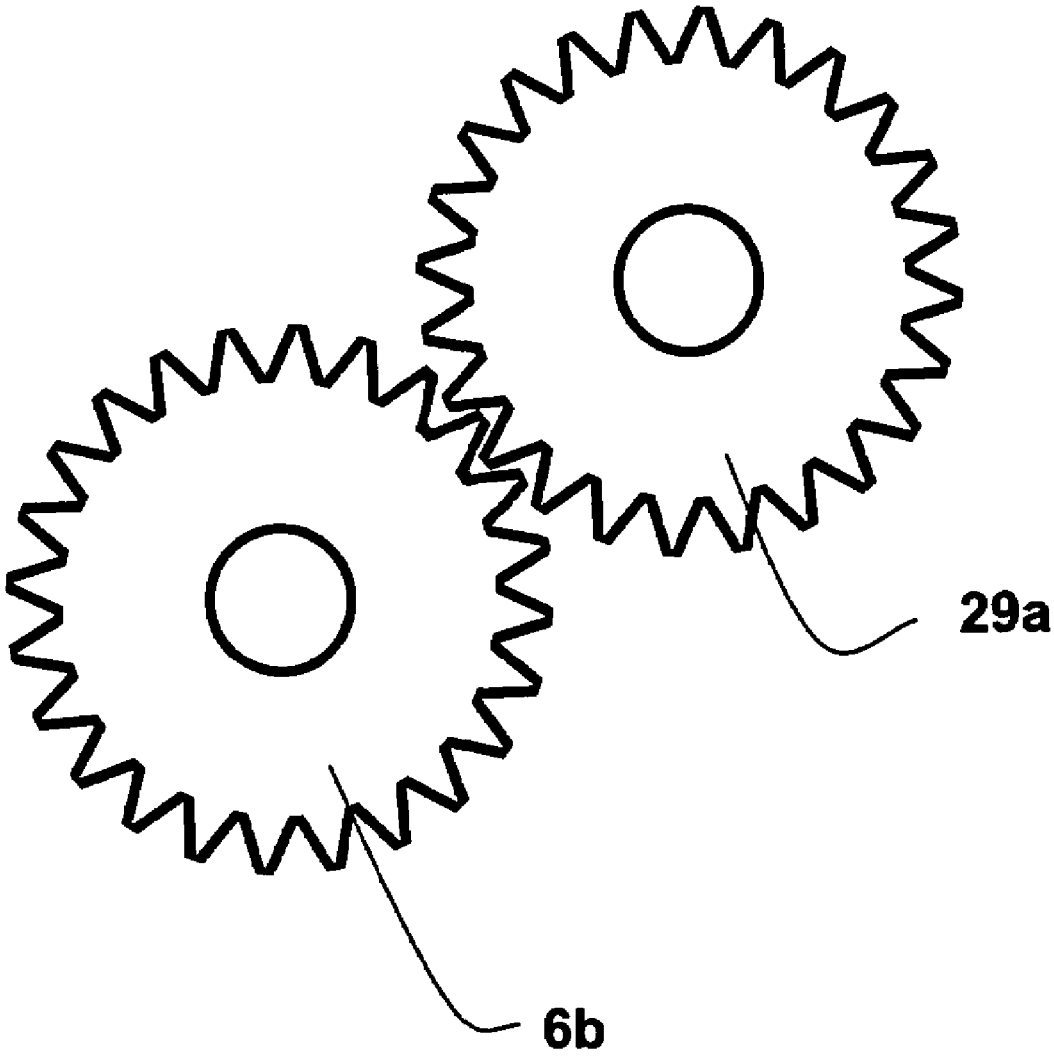
FIG. 3 is a view showing the first and second slant teeth gears, 6*b* and 29*a*, respectively.

FIG. 1 is a sectional view schematically showing the structure of the electronic color photography apparatus. In FIG. 1, designated by numeral 1 is the electronic color photography apparatus. A photosensitive belt 2 which is latent image holding means is provided in a substantially center part of a frame body, in an annular shape elongated in a vertical direction. Interposing this photosensitive belt 2, a transfer belt 3 which is an intermediate transfer body, a transfer device 11, a feeding device 9 of a recording medium 7, and a fixing device 12 are arranged at a left side in the drawing, and developing devices 6*k*, 6*y*, 6*m*, 6*c* which are respectively filled with toners having four different colors as the minute coloring powder are arranged at a right side in the drawing.

An exposing device 5 for forming a latent image on the photosensitive belt 2 is provided below the developing device 6*c*, and further below the exposing device 5, there is provided a paper feeding cassette 8 which contains the recording mediums 7 in stack.

The transfer device 11 and an intermediate transfer body cleaning device 14 are arranged around the transfer belt 3, whereas an electrifying device 4, an after image erasing device 18, and a photosensitive body cleaning device 17 are arranged around the photosensitive belt 2.

The photosensitive belt 2 is rotated in a direction of an arrow mark 20 by a driving device (not shown), and a photosensitive layer on its surface is uniformly electrified by the electrifying device 4. Then, the photosensitive belt 2 is exposed to light by the exposing device 5, in dot units, according to letter information or image information which has been made by a personal computer or a scanner, thereby to form an electrostatic latent image on the surface of the photosensitive belt 2. Thereafter, the electrostatic latent image on the photosensitive belt 2 is developed by selecting any of the developing devices 6*k*, 6*y*, 6*m*, 6*c*, thereby to form a toner image of the selected color. While the development is not conducted, the developing device 6 is retracted by a spring or the like for imposing a load in a direction of moving it away from the photosensitive belt 2 by such a distance or to such a position that the development cannot be effected with the minute particles such as toner on the photosensitive belt 2.

On the photosensitive belt 2 which has passed the first transfer position 21, the electrostatic latent image will be erased with uniform irradiation of light by the after image erasing device 18, and surface potential will be lowered below a certain level. Thereafter, the surface of the photosensitive belt 2 will be cleaned by removing the toner which has not been transferred at the first transfer position and remains on the surface of the photosensitive belt 2, by the photosensitive body cleaning device 17, and the photosensitive belt 2 is prepared for forming the next toner image.

One cycle of operation of forming and transferring the toner image in timing with one rotation of the transfer belt 3, as described above, will be sequentially repeated, selectively employing the developing devices 6*k*, 6*y*, 6*m*, 6*c*. In this manner, a color toner image having a plurality of colors which has been composed of single color toner images superposed one on another will be formed on the transfer belt 3.

The recording medium 7 such as recording paper or OHP sheet is supplied from the paper feeding device 9 and the paper conveying device 10 to the second transfer position 22, and the toner image of a single color or a plurality of colors which has been formed on the surface of the transfer belt 3 will be transferred onto the recording medium 7.

The recording medium 7 on which the toner image has been transferred will be peeled off from the transfer belt 3, and the toner image will be fixed by melting on the recording medium 7 by the fixing device 12. Then, the recording medium 7 will be discharged to a paper discharging tray on an upper face of the electronic color photography apparatus 1 by the paper discharging device 13.

Surplus toner remaining on the surface of the transfer belt 3 after the toner image has been transferred onto the recording medium 7 will be cleaned off by the intermediate transfer body cleaning device 14, and will be recovered into the toner recovery device 15. The transfer belt 3 which has been thus cleaned is prepared for transferring the next toner image.

In this manner, by simplifying as much as possible a conveying path of the recording medium 7 from a supply side to a discharge side, and by increasing a radius of curvature of the conveying path, it is possible to prevent a paper jam on the way of conveyance, and to enhance reliability. It is also possible to easily conduct clearing operation of the paper jam, when it has occurred. Further, this structure can be applied to such an electronic color photography apparatus that various types of recording mediums, even cardboard or the like can be used.

In this embodiment, the conveying path of the recording medium is formed in a substantially arc-shape, and the transfer belt 3, the photosensitive belt 2, the developing devices 6*k*, 6*y*, 6*m*, 6*c*, and the exposing device 5 are arranged inside the aforesaid conveying path of the recording medium. Therefore, this electronic color photography apparatus can be made small-sized by effectively utilizing the space inside the frame body, and constructed in such a manner that the conveying path can be simplified, and the recording medium 7 can be discharged with an image face directed downward.

According to this structure, the conveying path can be simplified. At the same time, because almost all constituent units are arranged inside the conveying path, the conveying path has come close to the frame body so that the conveying path can be easily made free, and so, clearing operation of the paper jam when it has occurred can be simplified. Further, because the recording medium 7 is discharged on the electronic color photography apparatus 1 with the image face directed downward, it is advantageous that when the recording mediums 7 discharged on the electronic color photography apparatus 1 are taken out with the image face directed upward, they are stacked in a printed order from an upper side to a lower side.

Still further, because the latent image holding body is composed of the photosensitive belt 2, and the photosensitive belt 2 is rendered to rotate along an oblong orbit so as to move rectilinearly in the developing region, it is possible to form a plurality of the developing devices 6*k*, 6*y*, 6*m*, 6*c* in a substantially same shape and arrange them so as to be opposed to the rectilinear region of the photosensitive belt 2, thereby to enhance productivity of the developing devices 6*k*, 6*y*, 6*m*, 6*c*. At the same time, it is possible to simplify an exchanging mechanism for selectively using one of the developing devices 6*k*, 6*y*, 6*m*, 6*c* according to the color to be developed, thereby to make the electronic color photography apparatus compact and low cost. Moreover, by arranging the photosensitive belt 2 in an elongated shape in a vertical direction, a space to be occupied by the photosensitive belt 2 having the same circumferential length can be minimized, and the electronic color photography apparatus 1 can be downsized.

When the recording medium 7 is conveyed upwardly from a lower part of the frame body, the transfer belt 3 is rotated in a direction of an arrow mark 23, and the photosensitive belt 2 is rotated in a direction of the arrow mark 20. In this manner, their rotations are made in the same direction at respective contact points, and the structure having least trouble of vibrations or so can be obtained. Further, by driving the transfer belt 3 following the photosensitive belt 2 in pressure contact therewith, transfer of a toner image having less deviation of colors can be realized. On this occasion, in case where the developing roller 19, for example, which is a toner carrier of the developing device 6*c* is constructed in a reverse developing system (a system wherein the developing roller 19 is rotated from the below to the above at a side of the photosensitive belt) by rotating it in a direction of an arrow mark 24, the opposed faces of the photosensitive belt 2 and the developing roller 19 can be rotated in the same direction. In this manner, the development can be performed with high developing efficiency and least trouble of vibration or so.

Then, referring to FIG. 2, a driving mechanism for the developing device will be described. In FIG. 2, the developing device 6 is provided with a plate 6*a* which is in parallel with the direction of approaching and separating the developing device 6, and a gear 6*b* which is in mesh with a gear 29*a* of a developing device driving mechanism 29 in the electronic color photography apparatus 1 for actuating the developing roller 19, and also adapted to come into mesh with a stopper 30 for determining a retracted position of the developing device 6 in the electronic color photography apparatus 1, when it is retracted. The plate 6*a* is located sideways. The electronic color photography apparatus 1 is further provided with a smoothly rotating roller 1*a*, at a position opposed to the plate 6*a* of the developing device 6. It would be preferable that the roller 1*a* is provided with a damper (spring) 1*b* for absorbing and moderating a shock of interference between the roller 1*a* and the developing device 6, because the damper 1*b* will absorb a sound or vibration of the shock, and also function as a holder for stabilizing the developing device 6.

When the gear 29*a* is rotated by the developing device driving mechanism 29, the gear 6*b* meshed with the developing roller 19 will be also rotated. On this occasion, a retracting force in a direction of an arrow mark 25 is applied to the developing device 6. Then, the developing device 6 will be rotated in a counterclockwise direction in the drawing, around a position where these two gears are meshed with each other.

On this occasion, the roller 1*a* acts as a stopper, and a force in a direction of an arrow mark 26 is converted into a force in a direction of an arrow mark 28. As the results, the developing device 6 will approach the photosensitive belt 2, while keeping the developing roller 19 in parallel with the photosensitive belt 2 at both sides thereof, whereby the development can be performed on the photosensitive body.

In case where the plate 6*a* and the roller 1*a* are not provided, nor positioned intentionally, the developing device 6 is sometimes rotated in a direction of an arrow mark 27, which makes it difficult that the developing roller 19 moves keeping a parallel position with respect to the photosensitive belt 2. When the developing roller 19 approaches the photosensitive belt 2 without keeping the parallel position, it will happen that the latent image on the photosensitive belt 2 cannot be developed from a left end part in the drawing (An image missing from an upper left part is printed on the recording medium). Moreover, this will cause a strange noise or vibration when the developing device 6 strikes an inner wall of the electronic color photography apparatus, or a defect of the image such as bounding.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electronic color photography apparatus comprising:

a photosensitive body; and a plurality of detachable developing devices, wherein among approaching and separating actions of the developing devices, a power for moving said developing devices close to said photosensitive body is created by a retracting force of a slanted teeth gear which is driven at one side of a body of the electronic color photography apparatus.

2. An electronic color photography apparatus according to claim 1, wherein a power for contacting the developing devices with the one side of body of the electronic color photography apparatus comprises a mechanism for smoothing the movements of the developing devices to come close to the photosensitive body.

3. An electronic color photography apparatus according to claim 2, wherein said mechanism for smoothing the movements of the developing devices to come close to the photosensitive body comprises a roller which is provided on the body of the electronic color photography apparatus.

4. An electronic color photography apparatus according to claim 1, wherein the photosensitive body comprises a photosensitive belt.

5. An electronic color photography apparatus according to claim 1, wherein the photosensitive body comprises latent image holding means provided in a substantially center part of a frame body of the electronic color photography apparatus, in an annular shape elongated in a vertical direction.

6. An electronic color photography apparatus according to claim 1, wherein while a development process is not conducted, said developing devices are retracted by a spring for imposing a load in a direction of moving said developing devices away from the photosensitive body to a distance that the development process is unaffected by particles on the photosensitive body.

7. An electronic color photography apparatus according to claim 1, wherein the photosensitive body is rendered to rotate along an oblong orbit.

8. An electronic color photography apparatus according to claim 1, wherein the photosensitive body is arranged in an elongated shape in a vertical direction.

9. An electronic color photography apparatus according to claim 1, wherein each developing device comprises a developing roller, and wherein a developing device driving mechanism actuates the developing roller.

10. An electronic color photography apparatus according to claim 9, further comprising:

a first slanted teeth gear transferring a driving force of the developing device driving mechanism to the developing roller;

a second slanted teeth gear meshed with said first slanted teeth gear, and provided with one end side of a rotation axis of the developing roller; and a stopper operable to determine a retracted position of the developing devices.

11. An electronic color photography apparatus according to claim 1, wherein said plurality of detachable developing devices are provided with a plate which is in parallel with a direction of approaching and separating the developing device to the photosensitive body, and wherein the electronic color photography apparatus further comprises a smoothly rotating roller placed at a position opposed to the plate.

12. An electronic color photography apparatus according to claim 11, wherein the smoothly rotating roller is engaged with a damper for absorbing a shock of interference between the smoothly rotating roller and the developing devices.

13. An electronic color photography apparatus according to claim 1, wherein a gear is in mesh with the slanted teeth gear for actuating a developing roller, and is adapted to come into mesh with a stopper for determining a retracted position of the developing device when it is retracted.

14. An electronic color photography apparatus according to claim 1, wherein each of said plurality of developing devices approaches the photosensitive body, while keeping a developing roller in parallel with the photosensitive body at both sides.

15. An electronic color photography apparatus according to claim 1, further comprising:

a smoothly rotating roller, wherein the rotating roller comprises a damper for absorbing and moderating a shock of interference between the rotating roller and said plurality of developing devices.

16. An electronic color photography apparatus comprising:

a photosensitive body; and a plurality of detachable developing devices, wherein among approaching and separating actions of the developing devices, a power for moving said developing devices close to said photosensitive body is arranged at one side of a body of the electronic color photography apparatus so as to form a substantially uniform nip in a lateral direction of paper.

17. An electronic color photography apparatus according to claim 16, wherein the photosensitive body comprises a photosensitive belt.

18. An electronic color photography apparatus according to claim 17, wherein rotation of the photosensitive body is a same direction as a rotation of a transfer belt at contact points of the transfer belt with the photosensitive body.

19. An electronic color photography apparatus comprising:

a plurality of developing devices capable of being filled with toners, each developing device having:

a developing roller; and a position determining section in parallel with a moving direction of the developing device;

a main body of the electronic color photography apparatus, the main body placing a roller to be contact with the position determining section;

a photosensitive belt forming a latent image by coming close to or being contact with the developing roller when the developing devices are moved, so that the electric color photography apparatus performs a color photography by transferring the latent image to a recording medium;

a developing device driving mechanism actuating the developing roller;

a first slanted teeth gear transferring a driving force of the developing device driving mechanism to the developing roller;

a second slanted teeth gear meshed with said first slanted teeth gear, and provided with one end side of a rotation axis of the developing roller; and a stopper operable to determine a retracted position of the developing devices.

20. The electronic color photography apparatus according to claim 19, wherein the roller is disposed on the main body of the electronic color photography apparatus through a spring.

* * * * *